US008290387B2

(12) United States Patent
Hara

(10) Patent No.: US 8,290,387 B2
(45) Date of Patent: Oct. 16, 2012

(54) IMAGE HEATING APPARATUS

(75) Inventor: Nobuaki Hara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 580 days.

(21) Appl. No.: 12/512,495

(22) Filed: Jul. 30, 2009

(65) Prior Publication Data

US 2010/0054786 A1 Mar. 4, 2010

(30) Foreign Application Priority Data

Aug. 27, 2008 (JP) ..... 2008-217840

(51) Int. Cl.
*G03G 15/20* (2006.01)
*G03G 15/00* (2006.01)

(52) U.S. Cl. ..... 399/69; 399/33; 399/90

(58) Field of Classification Search ..... 399/69, 399/33, 90

See application file for complete search history.

(56) References Cited

U.S. PATENT DOCUMENTS 6,175,713 B1 1/2001 Uehara et al. ..... 399/307
2007/0047991 A1* 3/2007 Itoh et al. ..... 399/69

FOREIGN PATENT DOCUMENTS

| | | |
|---|---|---|
| JP | 10-301415 | 11/1998 |
| JP | 11-352804 | 12/1999 |
| JP | 2004-37412 | 2/2004 |
| JP | 2006-78933 | 3/2006 |

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

An image heating apparatus includes a coil for generating magnetic flux; a rotatable heater, having an electroconductive layer which generates heat by the magnetic flux, for heating an image on a recording material, the heater being disposed inside the coil; a magnetic member; a detector, disposed in an area between the magnetic member and an area of the heater opposing the coil, for detecting a temperature of the heater; an electric wire electrically connected to the detector; and an interruptor, for interrupting electric power supply to the coil on the basis of an output of the detector supplied through the electric wire. The magnetic member includes an opening through which the wire passes.

13 Claims, 14 Drawing Sheets

(a)

(b)

IMAGE HEATING APPARATUS

FIELD OF THE INVENTION AND RELATED ART

The present invention relates to an image heating member (device) of an electromagnetic (magnetic) induction heating type suitably used as an image heating apparatus (device) of an electromagnetic (magnetic) induction heating type suitably used as the image forming apparatus to be mounted in an image forming apparatus, such as a copying machine, a printer, or a facsimile machine, for effecting image formation through an electrophotographic system, an electrostatic recording system, a magnetic recording system, or the like.

As the image heating apparatus (device), it is possible to use a fixing device for fixing or temporarily fixing an unfixed image on a recording material, a glossiness-enhancing device for enhancing the glossiness of an image fixed on the recording material by heating the image, and the like device. Further, it is also possible to use an image heating apparatus or the like used for quickly drying ink in an image forming apparatus of an ink jet type or the like in which image formation is effected by a liquid containing a dye or a pigment.

Generally, in an image forming apparatus using a powdery toner as developer, a step of fixing (heating) an unfixed toner image formed and carried on a recording medium (material) is performed by widely employing such a method that the recording material is nipped between an image heating member and a pressing member to heat the toner image so as to be pressure-bonded to the recording material. The image heating member and the pressing member are rotatable members which create a nip by press contacting each other. Further, at least the image heating member is heated to a predetermined temperature in this embodiment by a heating means. Of the heating means for heating the image heating member, the electromagnetic induction heating device generates heat in such a manner that an exciting coil is disposed to an electroconductive layer and magnetic flux is generated in the electroconductive layer to cause an eddy current in the electroconductive layer. According to the electromagnetic induction heating device, the image heating member can be directly heated, so that the image heating member can be caused to generate heat in a very short time. Such an image heating device is described in Japanese Laid-Open Application (JP-A) Hei 10-301415 and JP-A Hei 11-352804.

In order to detect an abnormal temperature rise of the image heating member, of temperatures at circumferential portions and longitudinal portions of the image heating member, it is necessary to detect a temperature at a portion showing a temperature as high as possible.

A fixing device disclosed in JP-A 2004-037412 includes a belt member supported in a non-stretched state, a belt guide member disposed near to an inner peripheral surface of the belt member, a pressing roller pressed against the belt member, and an electromagnetic induction heating device for heating the belt member. The belt member is a fixing member and the pressing roller is a pressing member. Further, a thermistor as a temperature detecting means is provided so as to contact the inner peripheral surface of the belt member on a downstream side of a press-contact portion between the belt member and the pressing roller with respect to a rotational direction of the belt member.

The thermistor in JP-A 2004-037412 is not configured to detect a temperature at a portion where the belt member opposes a coil, i.e., a temperature in a high temperature area in which heat is generated, so that there arises the problem of a lowering in response in the case where the belt temperature is abnormally increased. In order to enhance the response in such a case, such a constitution that the temperature at a heat generating portion, i.e., the portion where the belt member opposes the coil is detected may desirably be employed. For that purpose, the temperature detecting member is provided on the inner peripheral surface of the belt at the portion where the belt member opposes the coil.

In the case where a thickness of the belt as an example of the image heating member is small, a skin depth is larger than a thickness of the belt. For that reason, magnetic flux leaks toward the inner surface of the belt. In a state in which the leaked magnetic flux is diffused, the magnetic flux is not readily concentrated at the belt, so that the heat generating efficiency is lowered. For that reason, as described in JP-A 2006-078933, such a constitution that a magnetic core is disposed inside the belt and a thermistor or a thermal sensing portion is provided between the magnetic core and the belt is employed.

However, in order to enhance the heat generating efficiency, the gap between the image heating member and the magnetic core is required to be decreased. In such a constitution, when an electric wire of the temperature detecting member is routed between the image heating member and the magnetic core to the outside of the image heating member, the electric wire and the image heating member are liable to contact each other. The image heating member is rotated, so that when the frequency of contact between the electric wire and the image heating member is high, the electric wire and the image heating member are liable to abrade each other. As a result, the life time of each of the electric wire and the image heating member cannot be prolonged.

SUMMARY OF THE INVENTION

A principal object of the present invention is to reduce the degree of contact between a magnetic core and a temperature detecting member provided at an inner peripheral surface of an image heating member.

According to an aspect of the present invention, there is provided an image heating apparatus comprising:

a coil for generating magnetic flux;

a rotatable heat generating member, having an electroconductive layer which generates heat by the magnetic flux, for heating an image on a recording material, the heating member being disposed inside the coil;

a magnetic core disposed inside the heat generating member;

a temperature detecting member, disposed between an area sandwiched between the magnetic core and an area of the heat generating member opposing the coil, for detecting a temperature of the heat generating member;

an electric wire electrically connected to the temperature detecting member; and an interrupting portion, provided outside the image heating member, for interrupting electric power supply to the coil on the basis of an output of the temperature detecting member supplied through the electric wire, wherein the magnetic core provides a core lacking portion in an area opposing said coil through the heat generating member, and wherein through the core lacking portion, the electric wire is extended to an outside of the heat generating member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

(1) Image Forming Station

Figure 2:
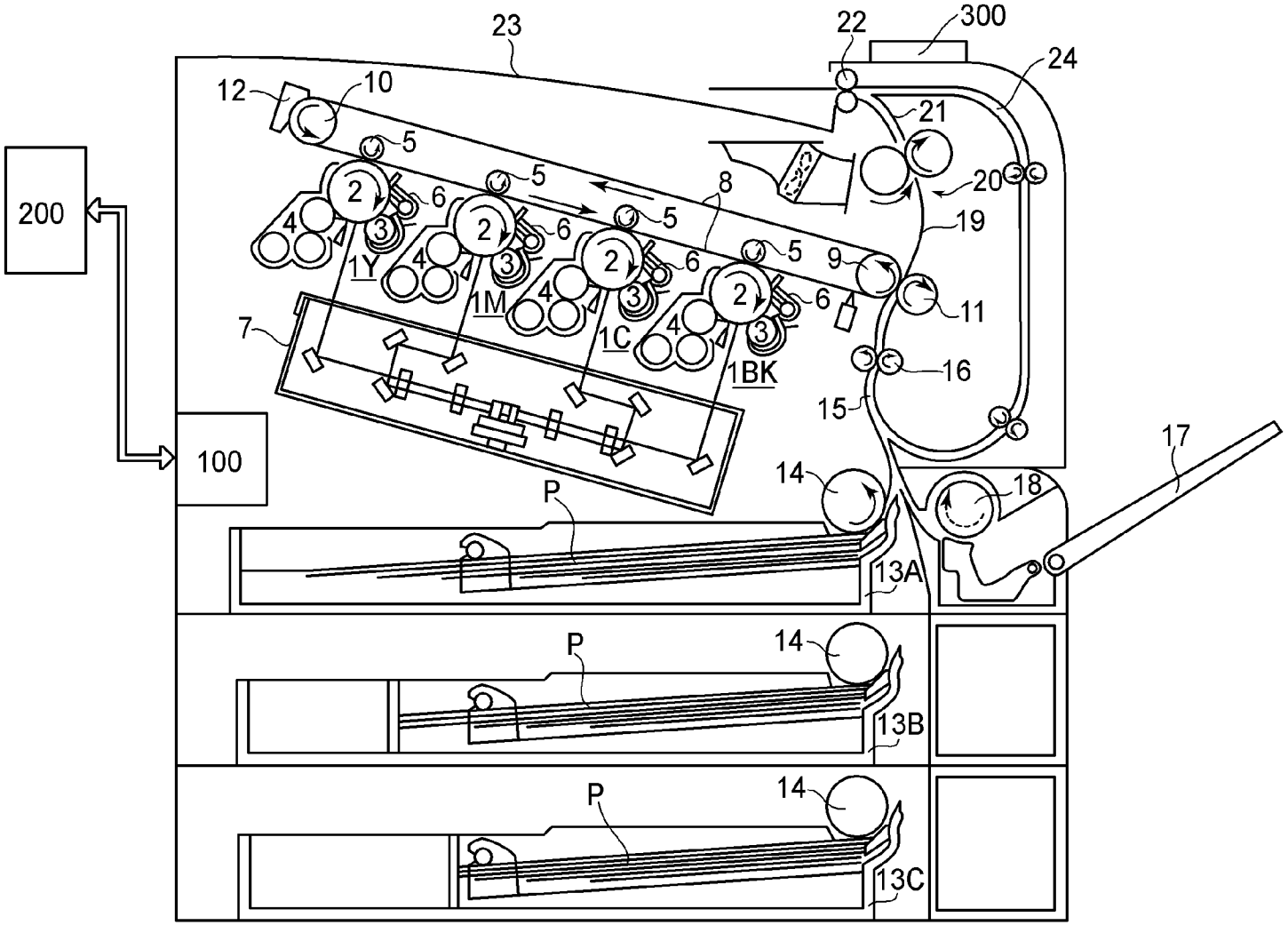
FIG. 2 is a longitudinal sectional view of an image forming apparatus in Embodiment 1.

FIG. 2 is a longitudinal schematic view showing a general structure of an electrophotographic full-color printer as an example of an image forming apparatus in which an image heating device (apparatus) according to the present invention is mounted as a fixing device (apparatus) 20. First, an image forming portion will be described.

This printer performs an image forming operation depending on image information inputted from an external host device 200 communicatably connected with a control portion (control board: CPU) 100, thus being capable of forming a full-color image on a recording material P and then outputting the full-color image.

The external host device 200 is a computer, an image reader, or the like. The control portion 100 sends signals to and receives signals from the external host device 100 or an operating portion 300 of the image forming apparatus. Further, the control portion 100 sends signals to and receives signals from various devices for image formation to manage an image forming sequence control An endless and flexible intermediary transfer belt 8 (hereinafter referred also simply to as a belt) is stretched between a secondary transfer opposite roller 9 and a tension roller 10 and is rotatable driven at a predetermined speed in a counterclockwise direction indicated by an arrow by rotation of the roller 9. A secondary transfer roller 11 presses the intermediary transfer belt 8 against the secondary transfer opposite roller 9. A press-contact portion between the intermediary transfer belt 8 and the secondary transfer roller 11 constitutes a secondary transfer portion.

First to fourth (four) image forming stations 1Y, 1M, 1C and 1Bk are disposed in line under the intermediary transfer belt 8 along a belt movement direction with a predetermined interval. Each of the image forming stations is an electrophotographic process mechanism of a laser exposure type and includes a drum-type electrophotographic photosensitive member 2 (hereinafter simply referred to as a drum) as an image bearing member to be rotationally driven at a predetermined speed in a clockwise direction indicated by an arrow. Around the drum 2, a primary charger 3, a developing device 4, a transfer roller 5 as a transfer means, and a drum cleaning device 6 are disposed. The transfer roller 5 is disposed inside the intermediary transfer belt 8 and presses the lower-side belt portion of the intermediary transfer belt 8 against the drum 2. A press-contact portion between the drum 2 and the intermediary transfer belt 8 constitutes a primary transfer portion. A laser exposure device 7 for each of the drums 2 of the respective image forming stations is constituted by a laser emitting means for emitting light correspondingly to a time-serial electric digital pixel signal of image information to be provided, a polygonal mirror, a reflection mirror, and the like.

The controller 100 causes each image forming station to perform an image forming operation on the basis of a color-separated image signal inputted from the external host device 200. As a result, at the first to fourth image forming stations 1Y, 1M, 1C and 1Bk, color toner images of yellow, cyan, magenta, and black are formed, respectively, on surfaces of associated rotating drums 2. An image forming process for forming a toner image on the drum 2 will be described. When an image input signal is inputted, the drum 2 is rotated. Therefore, the drum 2 is electrically changed by the primary charger 3. The laser exposure device 7 imagewise-exposes the charged drum 2 to light, so that an electrostatic latent image is formed on the drum 2. The electrostatic latent image formed on the drum 2 is developed by the developing device 4, so that a toner image is formed on the drum 2. This image forming process is performed at each of the image forming stations.

The toner images formed at the respective image forming stations are successively transferred onto an outer surface of the intermediary transfer belt 8, in a superposition manner, which is rotationally driven in the same direction as the rotational directions of the respective drums 2 at a speed corresponding to the rotational speeds of the respective drums 2. As a result, on the surface of the intermediary transfer belt 8, unfixed full-color toner images are synthetically formed in a superposition manner of the above-described four toner images.

With predetermined sheet feeding timing, a sheet-feeding roller 14 at a stage selected from vertical multi-stage sheet-feeding cassettes 13A, 13B, and 13C in which various recording material P having different widths are stacked and accommodated is driven. As a result, one sheet of the recording material P stacked and accommodated in the sheet-feeding cassette at the selected stage is separated and fed to be conveyed to registration rollers 16 through a vertical conveying path 15. When a manual sheet feeding mode is selected, a sheet-feeding roller 18 is driven. As a result, one sheet of the recording material placed and set on a manual sheet feeding tray (multi-purpose tray) 17 is separated and fed to be conveyed to the registration rollers 16 through the vertical conveying path 15.

The registration rollers 16 timing-convey the member P so that a leading end of the recording material P reaches the secondary transfer portion in synchronism with the time when a leading end of the above-described full-color toner images on the rotating intermediary transfer belt 8 reaches the secondary transfer portion. As a result, at the secondary transfer portion, the full-color toner images on the intermediary transfer belt 8 are secondary-transferred and collected onto the surface of the recording material P. The recording material P coming out of the secondary transfer portion is separated from the surface of the intermediary transfer belt 8 and guided by a vertical guide 19 into the fixing device (apparatus) 20. By this fixing device 20, the above-described toner images of a plurality of colors are melted and mixed to be fixed on the surface of the recording material as a fixed image. The recording material coming out of the fixing device 20 is sent onto a sheet discharge tray 23 as a full-color image formed product by sheet discharge rollers 22 through a conveying path 21.

The surface of the intermediary transfer belt 8 after the separation of the recording material at the secondary transfer portion is subjected to removal of residual deposited matter such as secondary transfer residual toner or the like by a belt cleaning device 12 to be cleaned, thus being repeatedly subjected to image formation.

In the case of a monochromatic print mode, only the fourth image forming station 1Bk for forming the black toner image is actuated. In the case where a both-side print mode is selected, a recording material which has been subjected to printing on a first surface is sent onto the sheet discharge tray 23 by the sheet discharge rollers 22. Immediately before a trailing end of the recording material passes through the sheet discharge rollers 22, rotation of the sheet discharge rollers 22 is reversed in direction. As a result, the recording material is subjected to switch back to be introduced into a re-conveying path 24. Thus, the recording material is conveyed again to the registration rollers 16 in a reversed state. Thereafter, similarly as in the case of the first surface printing, the recording material is conveyed to the fixing device 20 through the secondary transfer portion, thus being sent onto the sheet discharge try 23 as a both-side image formed product.

(2) Fixing Device 20

In the following description, a longitudinal direction of the fixing device or members constituting the fixing device refers to a direction parallel to a direction perpendicular to a recording material conveying direction in a plane of the recording material conveying path. This longitudinal direction is substantially identical to a rotational axis direction of a belt member 31*a* described later. Further, an upstream side and downstream side of the fixing device or the members constituting the fixing device refer to those with respect to a rotational direction of the belt member 31*a*.

Figure 1:
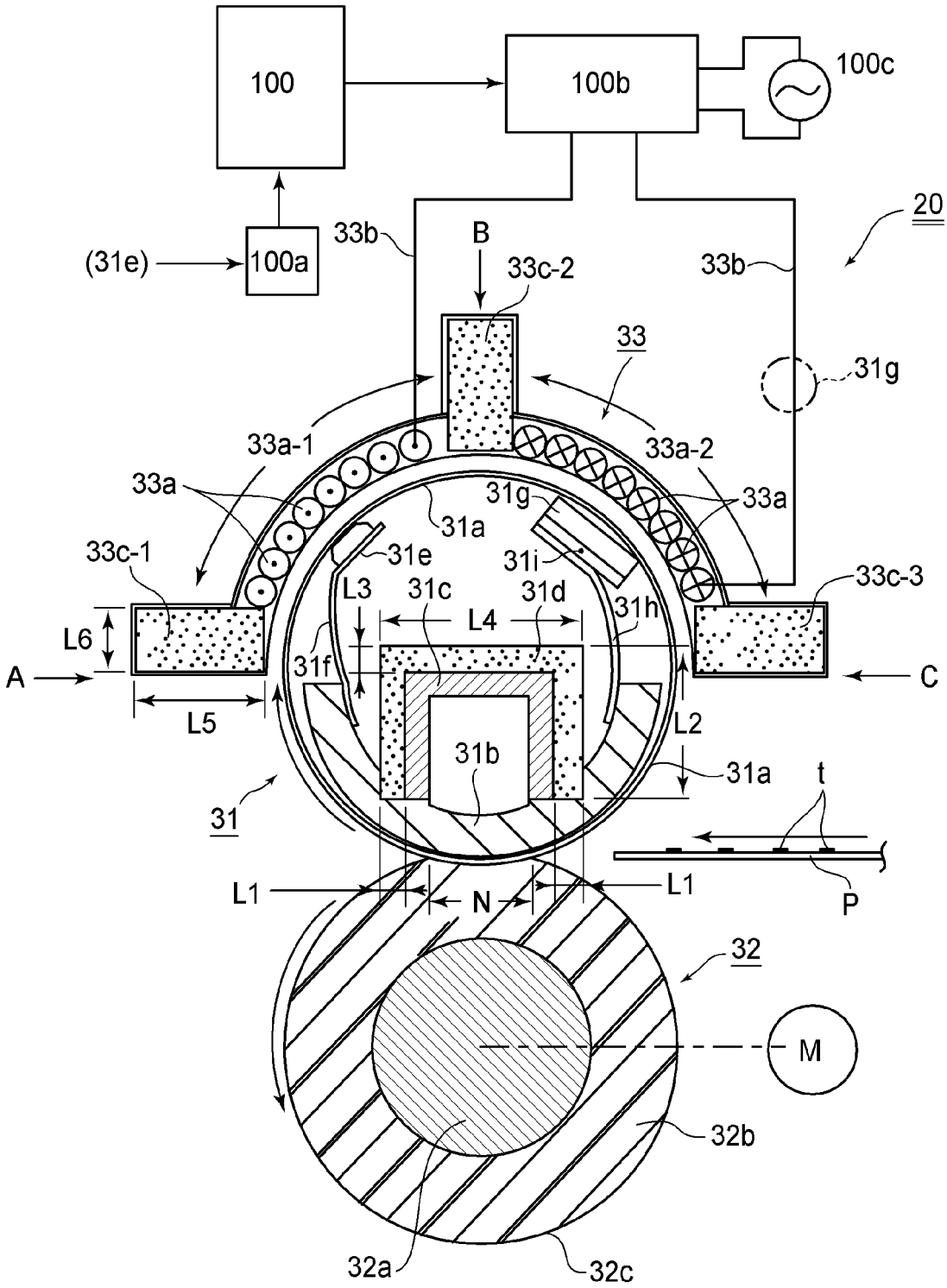
FIG. 1 is an enlarged schematic cross-sectional view of a fixing device (apparatus) in Embodiment 1.

FIG. 1 is an enlarged cross-sectional view showing a general structure of the fixing device 20 as an image heating device in this embodiment. The fixing device 20 includes a belt assembly 31, including the belt member 31*a*, which is the image heating member, disposed and held between opposite side plates of a device frame (not shown) at both longitudinal end portions of the belt assembly 31. The fixing device 20 further includes a pressing roller 32 as a pressing member having elasticity, which is a rotatable pressing member. Further, the fixing device 20 includes a coil unit 33 including a coil 33*a* as a magnetic field generating means. The belt member 31*a* and the pressing roller 32 press-contact each other to form a nip N therebetween having a predetermined width with respect to a recording material conveyance direction. The coil unit 33 is oppositely disposed outside the belt member 31*a* so as to be in non-contact with the belt member 31*a* with a predetermined spacing.

a) Belt Assembly 31

The belt assembly 31 includes the belt member 31*a*, as the rotatable image heating member, which is cylindrical and has flexibility. The belt member 31*a* has an electroconductive layer which generates heat through electromagnetic induction heating when the layer passes through an area in which a magnetic field (magnetic flux) generated from the coil unit 33 is present. The belt member 31*a* heats the toner image on the recording material by heat generated in the electroconductive layer.

The belt assembly 31 includes a belt guide member 31*b* which is disposed inside the belt member 31*a* (within the heat generating member) in a semi-arcuate cross-sectional shape and has heat resistivity and rigidity. The belt assembly 31 also includes a metal-made rigid pressing stay 31*c* disposed inside the guide member 31*b* in an inverted U-like cross-sectional shape. The belt assembly 31 further includes a magnetic core (magnetic shield core) 31*d*, as a magnetic shielding member, disposed in an inverted U-like cross-sectional shape so as to cover the outside of the stay 31*c*.

Figure 3:
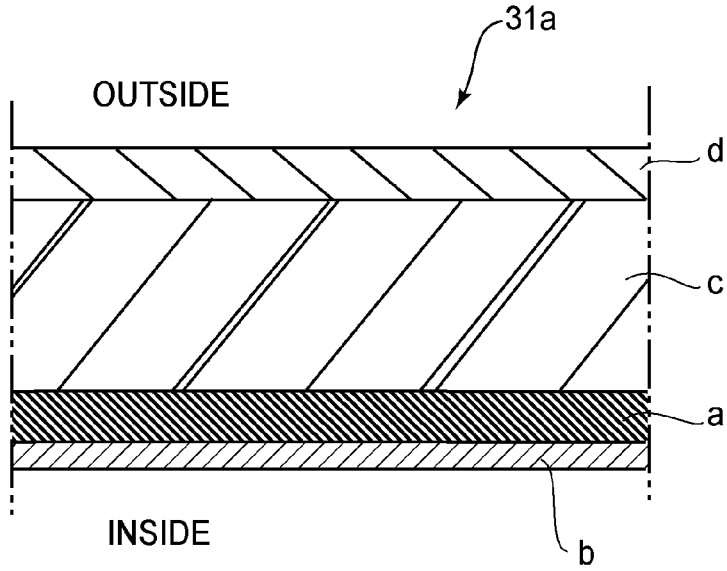
FIG. 3 is a schematic view showing a layer structure of a fixing belt.

FIG. 3 is a schematic view showing a layer structure of the belt member 31*a* in this embodiment. The belt member 31*a* is a member having a four-layer composite layer structure constituting of a cylindrical base layer a, an inner layer b provided at an inner peripheral surface of the base layer a, and an elastic layer c and a parting layer d which are successively laminated on an outer peripheral surface of the base layer a, thus having flexibility as a whole.

The base layer a is a layer of a magnetic member which generate heat through electromagnetic induction heating, i.e., an electroconductive layer (electroconductive member) and is an electromagnetic induction heating layer which generates an induced current (eddy current) by the action of the magnetic field of the coil unit 33 to generate heat by Joule heat. In this embodiment, as the base layer a, a 50 μm thick Ni (nickel) electro-formed layer (electroconductive member) having a diameter of 30 mm is used. The base layer a may preferably be thin in order to improve a quick start property thereof, but requires a certain degree of thickness in consideration of the efficiency of electromagnetic induction heating, so that the base layer a may preferably have a thickness of approximately 10-100 μm.

The inner surface layer b is provided to ensure slidability with a member contacting the inner surface of the belt. In this embodiment, a 15 μm-thick polyimide (PI) layer is used as the inner surface layer b. When the inner surface layer is excessively thick, the inner surface layer adversely affects the thermal responsiveness of a temperature detecting means such as a thermistor or the like provided in contact with the inner surface of the belt and adversely affects the quick start property of the fixing device, so that the inner surface layer may preferably have a thickness of approximately 10-100 μm.

The elastic layer c may preferably have a thickness as small as possible in order to improve the quick start property of the fixing device but requires a certain degree of thickness in order to achieve such an effect that the belt surface is softened to encompass and melt the toner. Therefore, the elastic layer C may preferably have a thickness of approximately 10-1000 μm. In this embodiment, a 400 μm-thick rubber layer having a rubber hardness (JIS-A) of 10 degrees and a thermal conductivity of 0.8 W/m·K is used.

As the parting layer d, it is possible to use a PFA tube or a PFA coating. The PFA coating can be decreased in thickness, thus being superior in material to the PFA tube in terms of a large effect of encompassing the toner. On the other hand, the PFA tube is superior to the PFA coating in terms of mechanical and electrical strength, so that it is possible to properly use the PFA tube and the PFA coating depending on the situation. In order to transfer heat to the recording material as much as possible, in either case, the parting layer d may preferably be thinner but may desirably have a thickness of approximately 10-100 μm in consideration of abrasion by the use of the fixing device. In this embodiment, a 30 μm-thick PFA tube is used.

The guide member 31*b* backs up and rotationally guides the belt member 31*a*, and the belt member 31*a* is externally engaged loosely with the guide member 31*b*. As the guide member 31*b*, a heat-resistant resin material can be used and in this embodiment, polyphenylene sulfide (PPS) is used. In this embodiment, the guide member 31*b* has a thickness of 3 mm.

The stay 31*c* has the function of pressing the guide member 31*b* and supporting the magnetic core 31*d*. The stay 31*c* has the function of suppressing bending of the guide member 31*b* at the time when the belt assembly 31 and the pressing roller 32 press-contact each other. In this embodiment, the stay 31*c* is constituted by SUS. The stay 31*c* has an inverted U-shaped cross section in a place perpendicular to the rotational axis direction of the belt member 31*a* and the inside of the stay 31*c* is a hollow space.

The magnetic core 31*d* is disposed inside the belt member 31*a* and opposes the coil unit 33 through the belt member 31*a* and has the function of further concentrating the magnetic flux which is generated by the coil unit 33 and is directed toward the inside of the belt member 31*a* (the heat generating member). Further, the magnetic core 31*d* also has the function of suppressing warming of the stay 31*c* through induction heating by covering an outer surface of the stay 31*c* as the metallic material to block the magnetic flux toward the stay 31*c*. As the magnetic core 31*d*, a material having high magnetic permeability and low loss is used. The magnetic core 31*d* is used for enhancing an efficiency of a magnetic circuit and for magnetic shielding with respect to the stay 31*c*. As a typical example of the material for the magnetic core 31*d*, ferrite core is used. In this embodiment, the magnetic core 31*d* has a dimension including thickness L1=2 mm, height L2=12 mm, thickness L3=2 mm, and width L4=16 mm.

Figure 4:
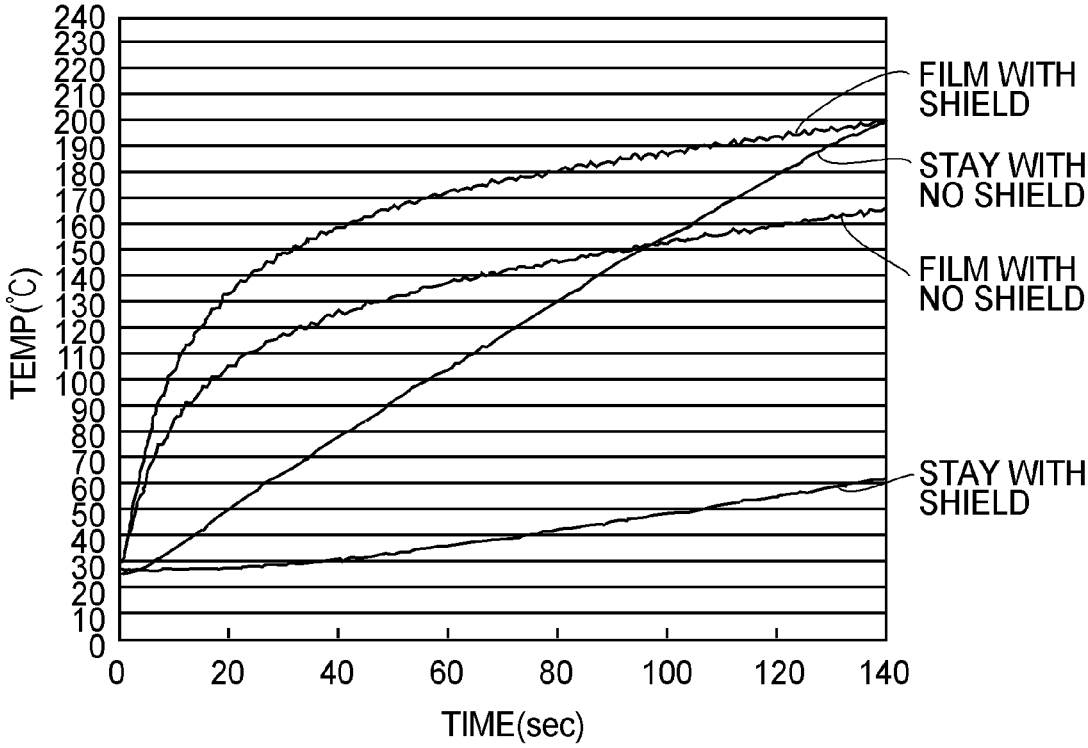
FIG. 4 is a graph showing a temperature change with time of each of respective members in the cases of mounting and not mounting a magnetic core on a stay.

FIG. 4 is a graph showing the temperature rise of the belt member 31*a* (film) and the stay 31*c* during start-up of the fixing device in the case where the magnetic core 31*d* as the magnetic shielding member is not mounted to the stay 31*c* and in the case where the magnetic core 31*d* is mounted to the stay 31*c*. In the case where the magnetic core 31*d* is mounted to the stay 31*c*, the temperature rise of the belt member 31*a* is quicker than that in the case where the magnetic core 31*d* is not mounted to the stay 31*c*. Further, in the case where the magnetic core 31*d* is not mounted to the stay 31*c*, the stay 31*c* is directly heated through the electromagnetic induction heating to be increased in temperature. For that reason, such an inconvenience that thermal breakage of the guide member 31*b* disposed in direct contact with the stay 31*c* occurs is caused. Further, in the case where the magnetic core 31*d* is not mounted to the stay 31, compared with the case where the magnetic core 31*d* is mounted to the stay 31, a degree of rise in the belt temperature is also slowed.

Figure 5:
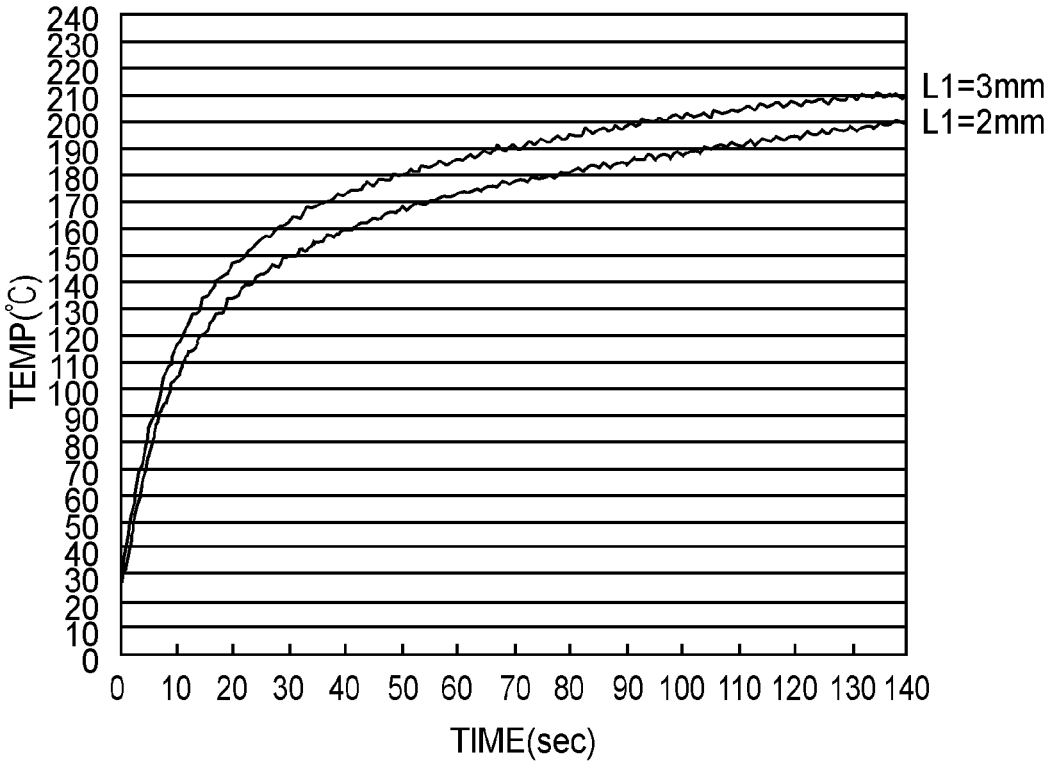
FIG. 5 is a graph showing a temperature change with time of belts including magnetic cores having different thicknesses.

As an comparative embodiment, the dimension of the magnetic core 31*d* is changed to a dimension including L1=3 mm, L2=13 mm, L3=3 mm, and L4=18 mm, thus being increased in thickness and is brought near to the belt member 31*a*. A graph for comparing temperature rise of this case with that of the above-described case (before the increase in thickness) of the dimension including L1=2 mm, L2=12 mm, L3=2 mm, and L4=16 mm is shown in FIG. 5. It is found that the temperature rise becomes quicker when the magnetic core 31*d* is increased in thickness and is brought near to the belt member 31*a*. In this case, however, a distance (spacing) between the magnetic core 31*d* and the belt member 31*a* is decreased, so that a member to be disposed in contact with the inner surface of the belt, such as a thermo-switch or the like is not placed or is less liable to be placed. Therefore, depending on a constitution of the fixing device, the thickness of the magnetic core 31*d* should be adjusted.

Inside the belt 31, a thermistor 31*e* as a first temperature detecting member for detecting the belt temperature in order to control the temperature of the belt member 31*a* is disposed. This thermistor 31*e* is caused to elastically contact the inner surface of the belt member 31*a* at its temperature detecting portion by a spring property of an elastic member 31*f* while a base portion thereof is held at an end portion of the elastic member 31*f* fixed to the guide member 31*b* or the magnetic core 31*d* at the other end. The thermistor 31*e* is caused to contact a portion which is a belt portion corresponding to the inside of an image forming area and at which the amount of heat generation of the belt member 31*a* by the coil unit 33 is largest, i.e., a portion at which the amount of heat generation at the inner surface of the belt member 31*a* with respect to the belt rotational direction is largest. Incidentally, in this embodiment, the thermistor 31*e* is disposed at the portion at which the amount of heat generation is largest but is not necessarily required to be disposed at the portion at which the amount of heat generation is largest. It is desirable that the thermistor 31*e* is disposed at a relatively high temperature portion. For that purpose, it is necessary to dispose the thermistor 31*e* in an area in which at least the thermistor 31*e* opposes the coil 33*a* through the belt member 31*a* and is disposed between the magnetic core 31*d* and the belt member 31*a*.

Electrical detection information (detected temperature information) on the temperature outputted from the thermistor 31*e* is inputted into the control portion 100 through an A/D converter 100*a*. The control portion 100 controls an electromagnetic induction heating driving circuit (a high-frequency converter) 100*b* so as to keep the belt temperature at a preset target temperature (an image heating temperature) on the basis of the detected temperature information from the thermistor 31*e*. That is, electric power supplied from an AC power source 100*c* to an exciting coil 33*a* of the coil unit 33 is controlled. Further, in the case where the thermistor 31*e* is used as an abnormal temperature detecting means for the belt member 31*a*, the control portion executes the following control. In the case where the temperature detected by the thermistor 31*e* reaches the preset temperature for a predetermined continuous time or more, the control portion 100 effects control so that the electric power supply from the AC power source 100*c* to the exciting coil 33*a* is interrupted. That is, in this case, the control portion 100 functions as a shut-off portion for shutting off the electric power supply from the AC power source 100*c* to the exciting coil 33*a*.

Further, inside the belt 31, a thermo-switch 31*g* as a second temperature detecting member (a temperature sensor) for detecting the belt temperature is disposed.

This thermo-switch 31*g* is caused to elastically contact the inner surface of the belt member 31*a* at its temperature detecting portion by a spring property of an elastic member 31*h* while a base portion thereof is held at an end portion of the elastic member 31*h* fixed to the guide member 31*b* or the magnetic core 31*d* at the other end. The thermo-switch 31*g* is caused to contact a portion at which the amount of heat generation of the belt member 31*a* by the coil unit 33 is largest, i.e., a portion at which the amount of heat generation at the inner surface of the belt member 31*a* with respect to the belt rotational direction is the largest. Incidentally, in this embodiment, the thermo-switch 31*g* is disposed at the portion at which the amount of heat generation is largest but is not necessarily required to be disposed at the portion at which the amount of heat generation is largest. It is desirable that the thermo-switch 31*g* is disposed at a relatively high temperature portion. For that purpose, it is necessary to dispose the thermo-switch 31*g* in an area in which at least the thermo-switch 31*g* opposes the coil 33*a* through the belt member 31*a* and is disposed between the magnetic core 31*d* and the belt member 31*a*.

Figure 6:
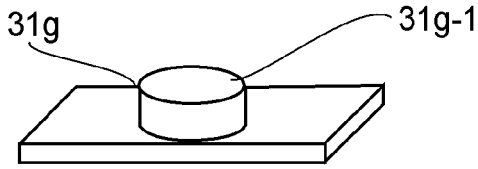
FIG. 6 is a schematic view for illustrating a temperature detection surface of a thermo-switch.

The thermo-switch 31*g* is connected serially to a feeder (line) 33*b*, for a magnetic field generating coil (exciting coil) 33*a* of the coil unit 33, through a thermo-switch wiring lead (line) 31*i*. When the temperature of belt member 31*a* is detected to reach a predetermined abnormal temperature or more, the electric power supply from the AC power source 100*c* to the coil 33*a* is shut off. FIG. 6 is a perspective view of the thermo-switch 31*g* in this embodiment. A temperature detection surface 31*g*-1 is a circular portion having a diameter of 8 mm in this embodiment. Further, from a surface opposite from the temperature detection surface 31*g*-1 of the thermo-switch 31*g*, an electric line (wire) 31*g*-2 is extended. In this embodiment, it was found that the thermo-switch 31*g* was able to be properly actuated when the temperature detection surface contacted a temperature portion at which the temperature was 80% or more of the temperature at the largest temperature portion on the inner surface of the belt member 31*a*.

b) Pressing Roller 32

The pressing roller 32 as the pressing member is decreased in hardness by providing an elastic layer 32*b* of a silicone rubber or the like to a core metal 31*a*. In order to improve a surface property, at an outer peripheral surface of the pressing roller 32, a fluorine-containing resin material layer 32*c* of PTFE, PFA, FEP, or the like may also be provided as a parting layer.

The pressing roller 32 in this embodiment as an outer diameter of 30.06 mm. The metal core 32*a* has a radius of 8.5 mm and is a solid member of SUS. The elastic layer 32*b* is formed of a silicone rubber in a thickness of 6.5 mm. The parting layer 32*c* is a PFA tube having a thickness of 30 μm.

The belt assembly 31 and the pressing roller 32 are disposed in parallel to each other. At a central portion of the guide member 31*b* with respect to an outer circumferential direction, the belt member 31*a* is caused to press-contact against the elasticity of the pressing roller 32 with a predetermined urging force. As a result, between the belt assembly 31 and the pressing roller 32, a fixing nip N with a predetermined width is formed with respect to the recording material conveyance direction.

The pressing roller 32 is rotationally driven at a predetermined speed in the counterclockwise direction indicated by an arrow (FIG. 1) by transmitting a driving force from a driving means (motor) M to the pressing roller 32 through a drive-transmission system (not shown). By the rotation of the pressing roller 32, a frictional force in the fixing nip N between the surface of the pressing roller 32 and the surface of the belt member 31*a* is produced, so that a rotational force acts on the belt member 31*a*. As a result, the belt member 31*a* is rotated, by the rotation of the pressing roller 32, at a speed substantially equal to the rotational speed of the pressing roller 32 in the clockwise direction indicated by an arrow around the guide member 31*b* while hermetically sliding on a lower surface of the guide member 31*b* at the inner surface of the belt member 31*a*.

c) Coil Unit 33

The coil unit 33 is curved along the outer peripheral surface of the cylindrical belt member 31*a* in a substantially semicircular range (substantially 180-degree range) in cross section. The coil unit 33 is disposed in parallel and oppositely to the belt member 31*a* with a predetermined spacing with respect to the outer surface of the belt member 31*a*. The coil unit 33 includes the magnetic field generating coil 33*a* for generating induced current in the base layer a as the magnetic member of the belt member 31*a* and includes magnetic cores 33*a* (33*c*-1, 33*c*-2, and 33*c*-3). The coil 33*a* is connected to the electromagnetic induction heating driving circuit 100*b* from which high-frequency electric power of 10-2000 kW is supplied.

In this embodiment, as the exciting coil 33*a*, a so-called Litz wire consisting of a plurality of enameled wire strands woven together is used in order to increase the conductor surface area for the purpose of suppressing the temperature rise of the coil. As a coating for the exciting coil 33*a*, a heat-resistant coating is used. The core 33*c* is formed of a material having high magnetic permeability and low loss. The magnetic cores 33*c* are used for enhancement of the efficiency of the magnetic circuit and for magnetic shielding. As a typical magnetic core, ferrite core can be used. In this embodiment, as the magnetic cores 33*c*, first to third (three) parallel rectangular cores 33*c*-1, 33*c*-2, and 33*c*-3 in cross section are used. The first core 33*c*-1 is located on an upstream side of the coil unit 33 with respect to the rotational direction of the belt member 31*a*. The third core 33*c*-3 is located on a downstream side of the coil unit 33 with respect to the rotational direction of the belt member 31*a*. The second core 33*c*-2 is located at an intermediate position between the first and third cores 33*c*-1 and 33*c*-3. In this embodiment, the coil 33*a* is constituted by using the above-described Litz wire so as to be wounded 8 circumference about the second core 33*c*-2. The coil 33*a* includes an upstream-side coil bundle portion 33*a*-1 located between the first and second cores 33*c*-1 and 33*c*-2 and a downstream-side coil bundle 33*a*-2 located between the second and third cores 33*c*-2 and 33*c*-3. The directions of the electric current passing through the upstream-side coil bundle portion 33*a*-1 and the downstream-side coil bundle portion 33*a*-2 are opposite from each other with respect to a longitudinal direction of the belt. The first to third parallel cores 33*c*-1, 33*c*-2, and 33*c*-3 have the same cross-sectional dimension including a long side L5=10 mm and a short side L6=5 mm.

d) Fixing Operation

The control portion 100 turns on the driving means M and the electromagnetic induction heating driving circuit 100*b* at least during the execution of the image forming operation on the basis of an image formation start signal. By the turning-on of the driving means M, the pressing roller 32 is rotationally driven, followed by rotation of the belt member 31*a*. Further, by the turning-on of the electromagnetic induction heating driving circuit 100*b*, the high-frequency current is passed through the exciting coil, so that the base layer a of the belt member 31*a* generates heat through the induction heating by the magnetic field generated by the coil 33*a*. By the heat generation of the base layer a, the rotating belt member 31*a* is increased in temperature. Then, the temperature of the belt member 31*a* is detected by the thermistor 31*e*, so that the detected temperature information is inputted into the control portion 100 through the A/D converter 100*a*. The control portion 100 controls the electromagnetic induction heating driving circuit 100*b* so that the belt temperature is increased and kept at the preset target temperature (image heating temperature) on the basis of the detected temperature information from the thermistor 31*e*. That is, the control portion 100 controls the electric power supply from the AC power source 100*e* to the exciting coil 33*a*.

In the above-described manner, the pressing roller 32 is driven and the belt member 31*a* is temperature-controlled so as to increase in temperature up to the predetermined image heating temperature. Then, in this state, the recording material P having thereon unfixed toner images t is introduced into the nip N with a toner image carrying surface directed toward the belt member 31*a* side. The recording material P intimately contacts the outer peripheral surface of the belt member 31*a* in the fixing nip N and is nip-conveyed through the fixing nip N together with the belt member 31*a*. As a result, the heat of the belt member 31*a* is applied to the recording material P and the recording material P is subjected to application of the pressing force in the fixing nip N, so that the unfixed toner images t are heat-fixed to the surface of the recording material P. The recording material P having passed through the fixing nip N is separated from the outer peripheral surface of the belt member 31*a* to be conveyed to the outside of the fixing device.

(3) Arrangement of Temperature Detecting Member

Figure 7:
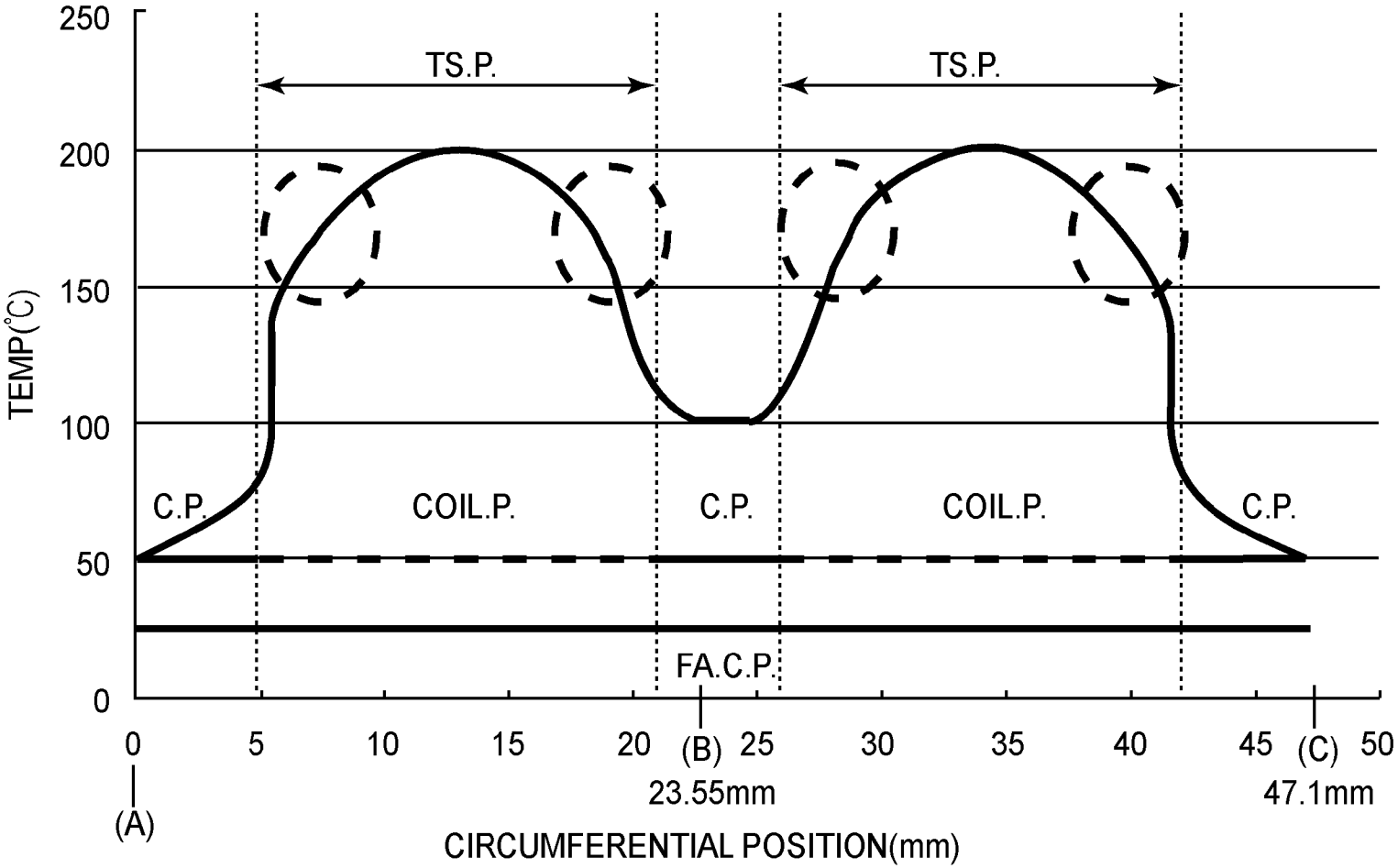
FIG. 7 is a graph showing a temperature distribution with respect to a circumferential direction of a belt during a rest of the belt.

In the case where study on heating of the fixing device 20 without rotating the belt member 31*a* in the constitution described above is made, a temperature distribution of the belt member 31*a* with respect to a circumferential direction of the belt member 31*a* is as shown in FIG. 7.

In the fixing device 20 in this embodiment, the coil unit 33 covers the substantially semi-circular area (the substantially 180-degree area) of the cylindrical belt member 31*a*, with a diameter of about 30 mm, of the belt member 31 and opposes the belt assembly 31. With respect to a circumferential position of the belt member 31*a* as an abscissa of FIGS. 7, (A), (B), and (C) represent circumferential belt positions corresponding to the first core 33*c*-1, the second core 33*c*-2, and the third core 33*c*-3, respectively, of the coil unit 33. The position (A) is taken as a position of 0 mm. The position (B) is a position of 23.55 mm from the position (A). The position (C) is a position of 47.1 mm from the position (A). That is, the coil unit 33 covers the belt member 31*a* in a circumferential range of 47.1 mm.

As is understood from FIG. 7, the belt temperatures at the portions (C.P.) opposing the cores 33*c*-1, 33*c*-2, and 33*c*-3 on the coil unit 33 side are low. Therefore, it is found that the position of the thermo-switch 31*g* (TS.P.) is required to be located oppositely to a coil position (COIL.P.), not oppositely to the core positions (C.P.) of the coil unit 33, in order to dispose the thermo-switch 31*g* at a position where the temperature of the belt member 31*a* is as high as possible. Incidentally, in this embodiment, the arrangement of the thermo-switch 31*g* is described above. However, even in such a constitution that the temperature detecting member such as a thermistor is disposed in place of the thermo-switch 31*g* at a similar position in the image forming apparatus having the function of detecting the belt temperature through the thermistor and interrupting energization to the coil when the detected temperature reaches the preset temperature, it is possible to achieve a similar effect in the present invention. That is, when the temperature detected by the thermistor reaches the preset temperature which is higher than the image heating temperature, the control portion determines that the fixing device is operating under abnormal conditions, so that the energization to the coil is interrupted.

Figure 8:
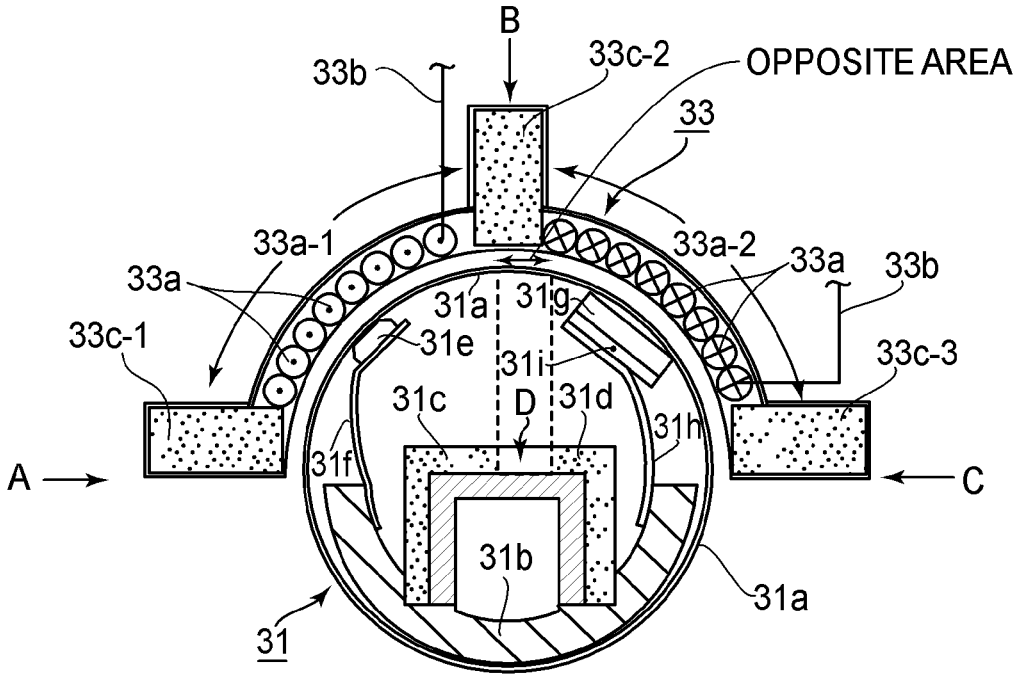
FIGS. 8(*a*) and 8(*b*) are schematic views showing a positional relationship among parts of a magnetic core in a comparative embodiment.
Figure 8:
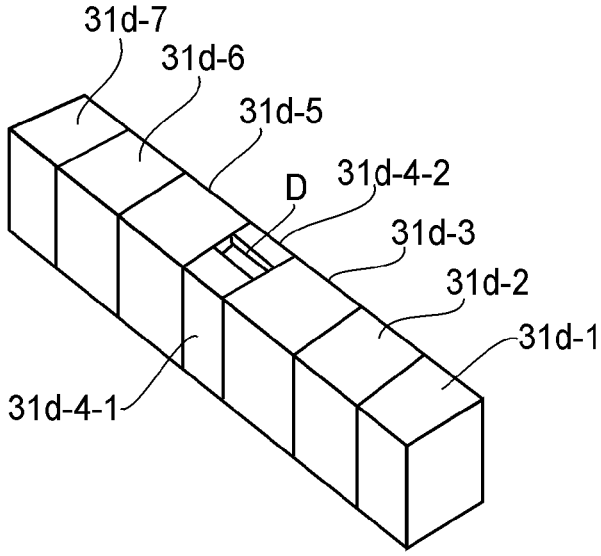

An embodiment of a fixing device having a lacking portion (opening) at which the magnetic core is absent is shown in FIGS. 8(*a*) and 8(*b*). In this embodiment, as shown in FIG. 8(*a*), a core lacking portion D is provided to an upper surface portion of the core 31*d* in the belt member 31*a*. FIG. 8(*b*) is a perspective view of the core 31*d*. The core 31*d* includes a plurality of cores arranged in a rotational axis direction of the belt member 31*a*. That is, magnetic cores 31*d*-1 to 31*d*-7 are disposed in such a manner that the magnetic core 31*d*-2 is disposed adjacent to the magnetic core 31*d*-1. A gap (spacing) between adjacent magnetic cores is about 1 mm in order to concentrate the magnetic flux, so that the magnetic cores are densely disposed. The core lacking portion D is disposed between the magnetic core 31*d*-4-1 and the magnetic core 31*d*-4-2. That is, a full length of an area including the lacking portion D in the rotational direction of the belt member 31*a* is smaller than those of adjacent areas. In this embodiment, the lacking portion D is provided between independent magnetic cores 31*d*-4-1 and 31*d*-4-2 but may also be provided by providing an opening at a portion as a part of a single magnetic core.

Figure 9:
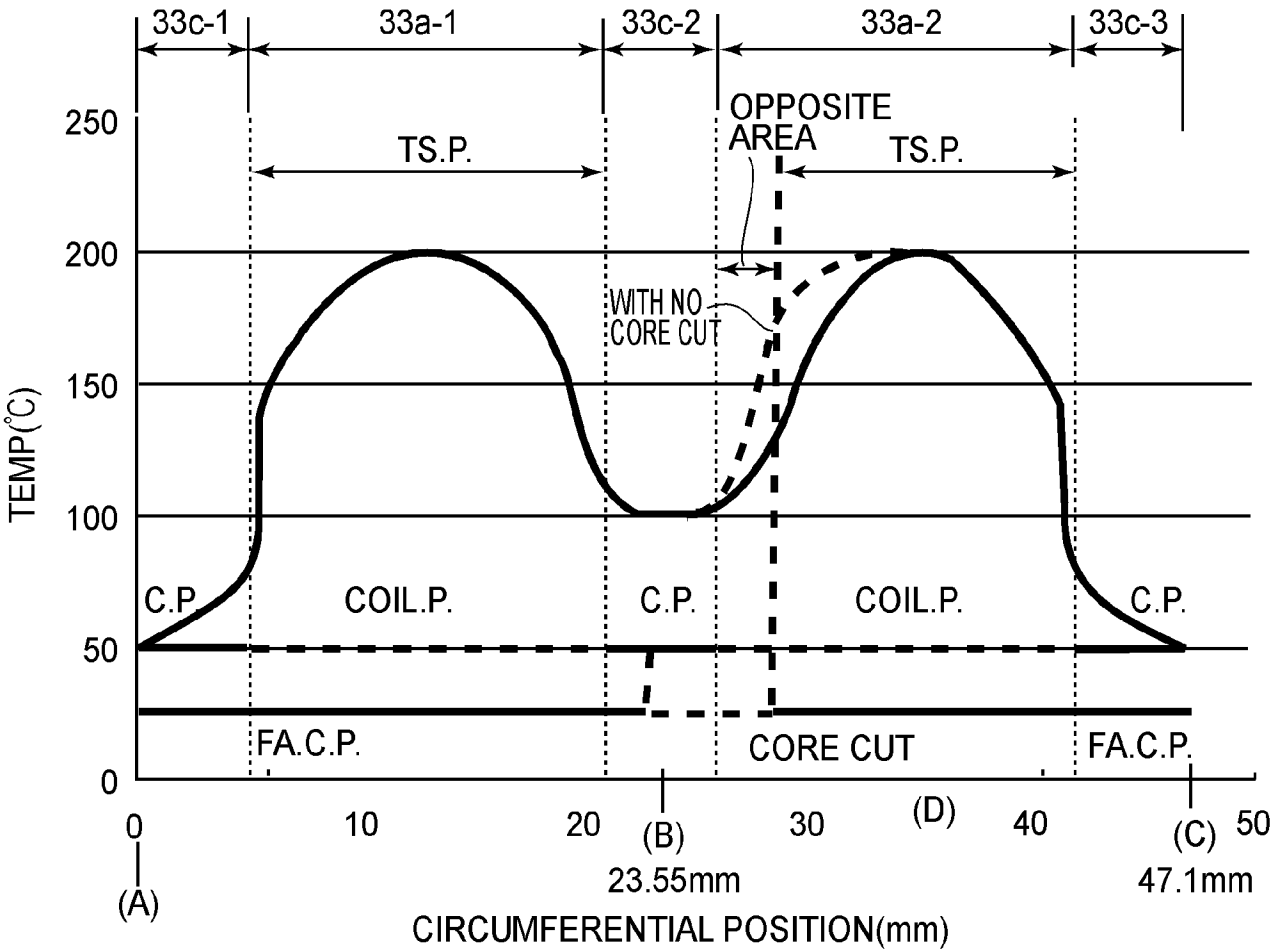
FIG. 9 is a graph showing a temperature distribution with respect to a circumferential direction of a belt during rest of the belt in the comparative embodiment of FIGS. 8(*a*) and 8(*b*).

As a result of study on heating of the belt member 31*a* during non-rotation of the belt member 31*a* in the fixing device was made, it was found that the temperature distribution of the belt member 31*a* with respect to a circumferential direction was as shown in FIG. 9. That is, such a result that the belt temperature at a portion opposite to the core lacking portion D on the belt assembly 31 side is obtained. An opposite area, shown in FIG. 9, in which the belt member 31*a* opposes the core lacking portion D will be described. An area of the belt member 31*a* opposing the core lacking portion D refers to the opposite portion. In other words, the opposite area is a projected portion of the core lacking portion onto the image heating member. This may be attributable to a decrease in induced magnetic field in the belt at a portion opposite to the core lacking portion D.

Thus, it is understood that a portion at which the coil 33*a* of the coil unit 33 overlaps with the core 31*d* of the belt assembly 31 may preferably be used as a place in which the thermo-switch 31*g* is provided for properly detecting the high temperature of the belt member 31*a*. In other words, it is understood that a proper place for providing the thermo-switch 31*g* is a place (position) located between the coil 33*a* of the coil unit 33 and the core 31*d* of the belt assembly 31.

Figure 10:
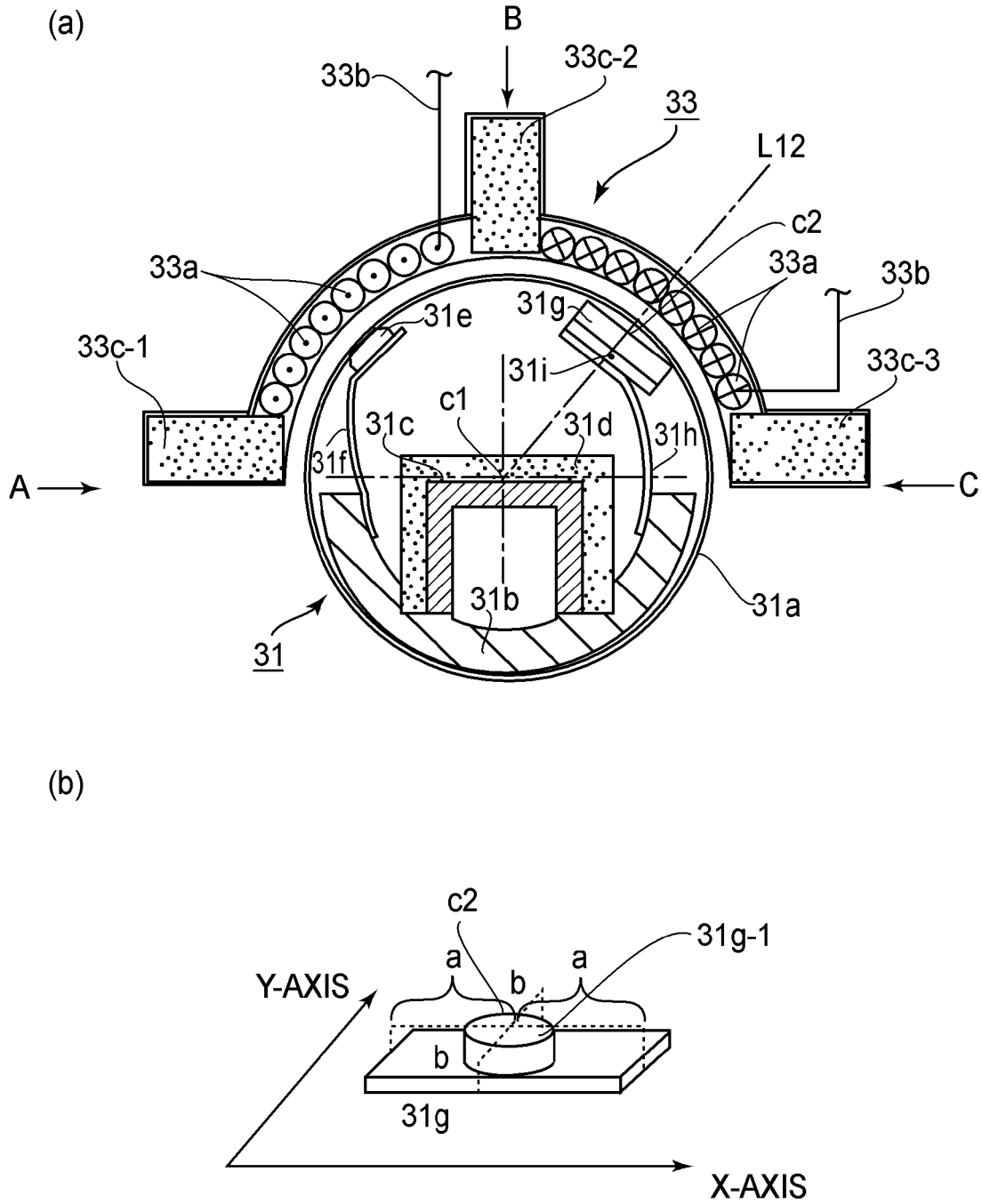
FIGS. 10(*a*) and 10(*b*) are schematic views for illustrating a reference line for defining a positional relationship among a magnetic core of a belt assembly, a thermo-switch, and a coil of a coil unit.

Herein, the positional relationship among the thermo-switch 31*g*, the coil 33*a*, and the core is defined on the basis of a reference line L2 connecting a center c1 of the belt with a center c2 of the thermo-switch 31*g* as seen from the outside of the belt assembly 31 in the cross-sectional view of FIG. 10(*a*). That is, the positional relationship refers to the arrangement of the coil 33*a* of the coil unit 33, the thermo-switch 31*g*, and the core 31*d* of the belt assembly 31 in line in this order.

Further, as shown in FIG. 10(*b*), the center c2 of the thermo-switch 31*g* refers to a midpoint of a thermo-switch width 2*a* (a+a) with respect to an X-axis direction and of a thermo-switch width 2*b* (b+b) with respect to a Y-axis direction when the X-axis and the Y-axis are defined in a plane parallel to the temperature detection surface 31*g*-1.

Figure 11:
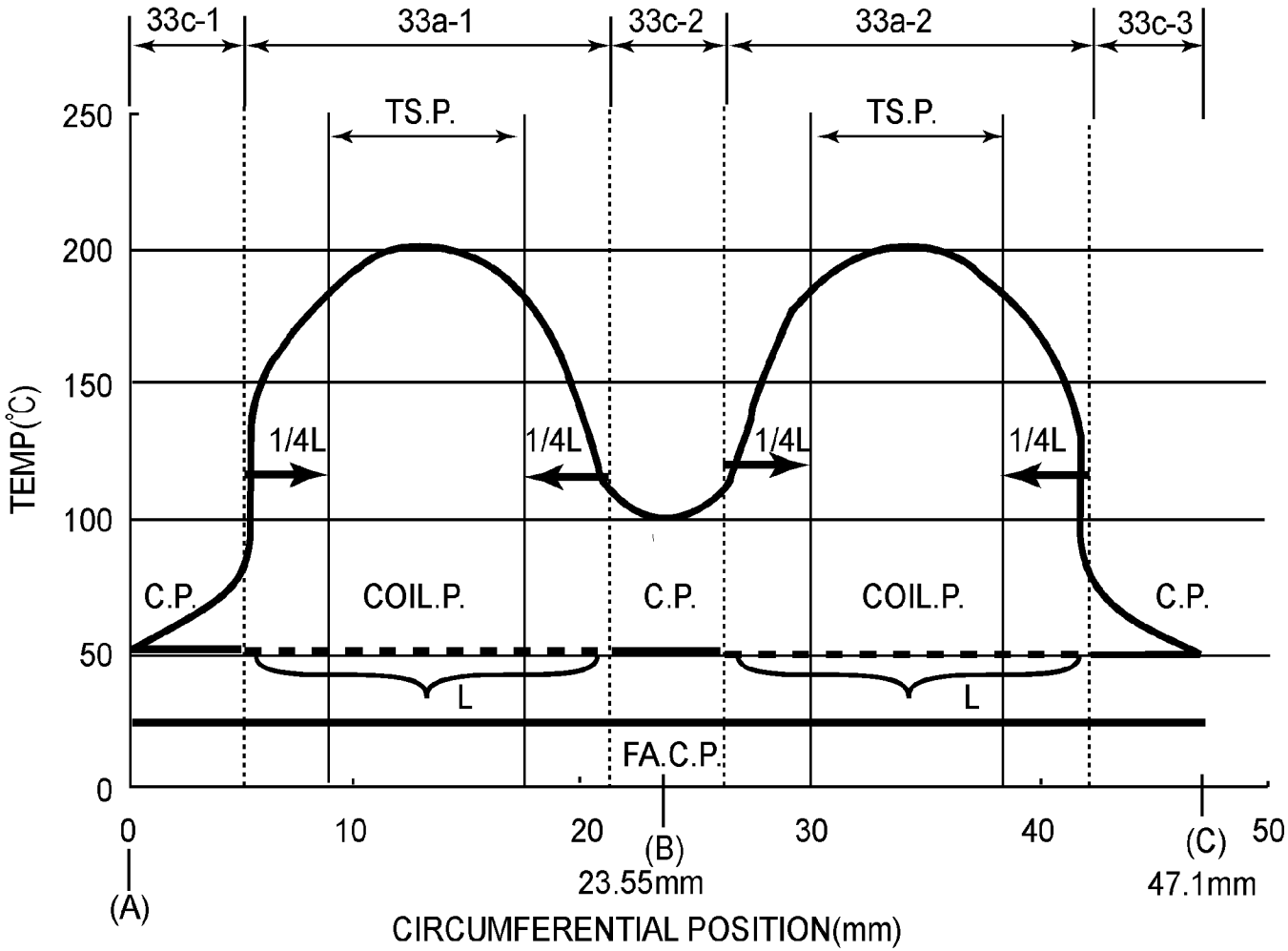
FIG. 11 is a schematic view showing a position of a thermo-switch in a preferred embodiment.

Further, in FIG. 7, the belt temperatures at a circular portions indicated by broken lines are somewhat lower than those of the maximum temperature portions, so that it is not preferable that the thermo-switch is disposed at these portions if possible. That is, in a preferred embodiment, when an area in which the coil position of the coil unit overlaps with the core position of the belt assembly is taken as L, an area located inside by (¼) L from each of both ends the overlapping area L is suitable for providing the thermo-switch. In this area, the belt temperature is 80% or more of that at the maximum temperature portion. A preferred position of the thermo-switch shown in FIG. 7 is as illustrated in FIG. 11.

In this embodiment, the thermo-switch 31*g* is described as an example of the temperature detecting member but the thermistor 31*e* as the temperature detecting member for detecting the abnormal temperature and shutting off the energization to the coil may also be disposed as described above.

Next, a relationship between the core lacking portion and wiring of the thermo-switch 31*g* will be described.

Figure 12:
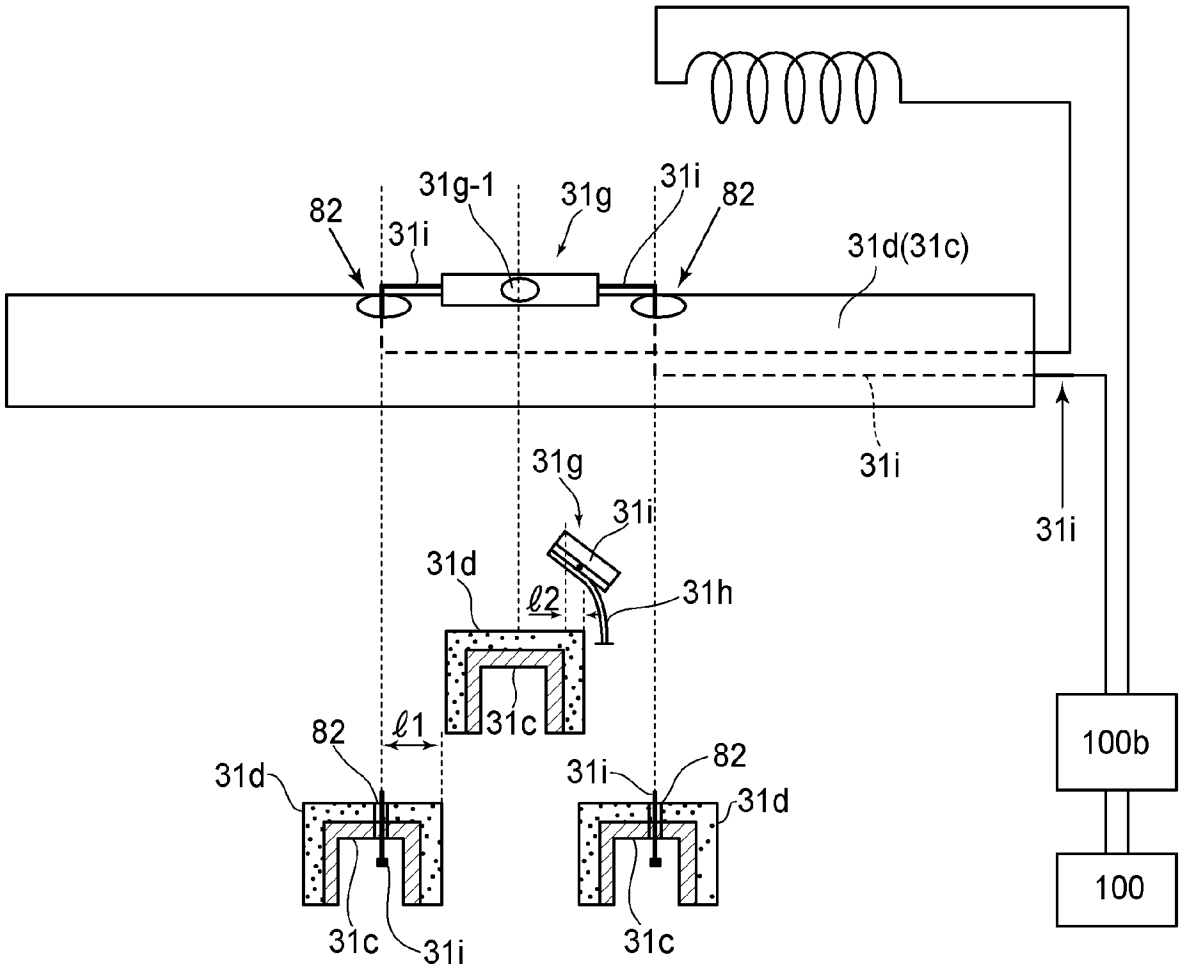
FIG. 12 is a schematic view for illustrating an example of thermo-switch wiring in Embodiment 1.

The thermo-switch wiring line 31*i* as an electric wire (line) for connecting the thermo-switch 31*g* with a coil wire (line) outside the image heating member is, as shown in FIG. 12, passes through the inside of the stay 31*c* by providing a hole 82 as the core lacking portion in the core 31*d* and the stay 31*c*. Thus, by disposing the electric wire inside the stay 31*c*, the narrow area disposed between the core 31*d* and the belt member 31*a* can be reduced. For that reason, an opportunity for contact between the electric wire and the belt member 31*a* is reduced, so that the degree of abrasion of each of the electric wire and the belt member 31*a* can be decreased.

The wiring line 31*i* passes through the inside of the stay 31*c* by the providing the hole 82 in the core 31*d* and the stay 31*c*. However, in view of also the matter described above with reference to FIGS. 8 and 9, the hole 82 provided in the core 31*d* and the stay 31*c* is not provided at the thermo-switch opposing portions, but is provided at portions deviated from the thermo-switch opposing portions in the longitudinal direction. Further, a distance l1 from the core end to the center of the hole along the core surface is made larger than a distance l2 from the core end to the end of the temperature detecting portion along the core surface, so that the hole 82 is provided at a portion deviated from the thermo-switch opposing portion also with respect to the circumferential direction. In this embodiment, such a constitution that the holes are disposed at the portions deviated from the temperature detecting portion with respect to both of the longitudinal direction and the circumferential direction is employed, but this hole deviation constitution may also be employed with respect to at least one of the longitudinal direction and the circumferential direction. This is because, as described above with reference to FIGS. 8 and 9, a lowering in temperature at the belt portion is caused to occur when the core lacking portion D is provided at a portion where a core portion opposing the thermo-switch partly lacks.

The thermo-switch electrically forms a series circuit with the coil 33*a*, so that the energization from the electromagnetic induction heating driving circuit 100*b* to the coil 33*a* is shut off when the temperature of the thermo-switch reaches a predetermined temperature.

Figure 13:
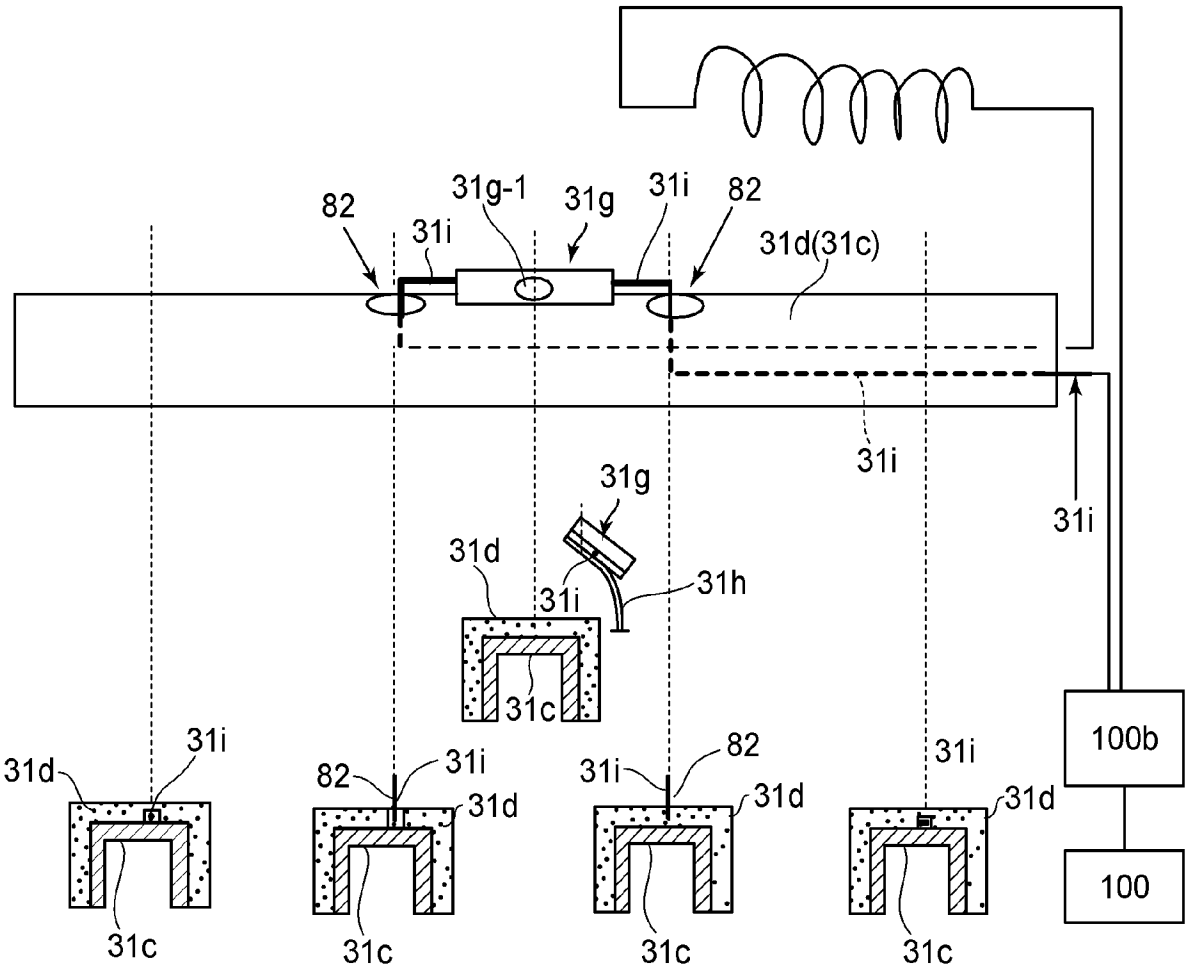
FIG. 13 is a schematic view for illustrating another example of thermo-switch wiring in Embodiment 1.

Further, as shown in FIG. 13, it can also be considered that the holes 82 are provided only in the core 31*d* without being provided in the stay 31*c* and the wiring line 31*i* is passed between the stay 31*c* and the core 31*d*. In this case, compared with the case where the holes 82 are provided in both of the core 31*d* and the stay 31*c*, there is an advantage such that the degree of bending of the stay 31*c* is decreased. However, it is considered that the temperature of the wiring line 31*i* is increased during the operation of the fixing device compared with the case where the holes 82 are provided in both of the core 31*d* and the stay 31*c*. Therefore, the route of the wiring line can be appropriately selected depending on the constitution of the fixing device.

In this embodiment, the arrangement of the thermo-switch and the wiring for the thermo-switch are described above. However, in the present invention, a similar effect can be achieved by employing the constitution of the arrangement and wiring for the temperature detecting member, such as a thermistor, similar to those for the thermo-switch in an image forming apparatus having the function of interrupting energization to the coil when the detected temperature reaches the preset temperature. That is, when the temperature detected by the thermistor reaches the preset temperature higher than the image heating temperature, the control portion 100 determines that the fixing device operates under abnormal conditions and then interrupts the energization to the coil. At that time, the control portion 100 has the function of shutting off the energization to the coil. Further, the wiring line from the thermistor passes through the hole as described above and is extended to the outside of the image heating member through the inside of the stay or through between the stay and the core. Then, the wiring line is, as shown in FIG. 1, electrically connected to the A/D converter 100*a*.

Embodiment 2

In this embodiment, the principal constitution thereof is the same as that in Embodiment 1, and thus a description thereof is omitted. In this embodiment, the inner structure of a belt assembly is different from that in embodiment 1.

Figure 14:
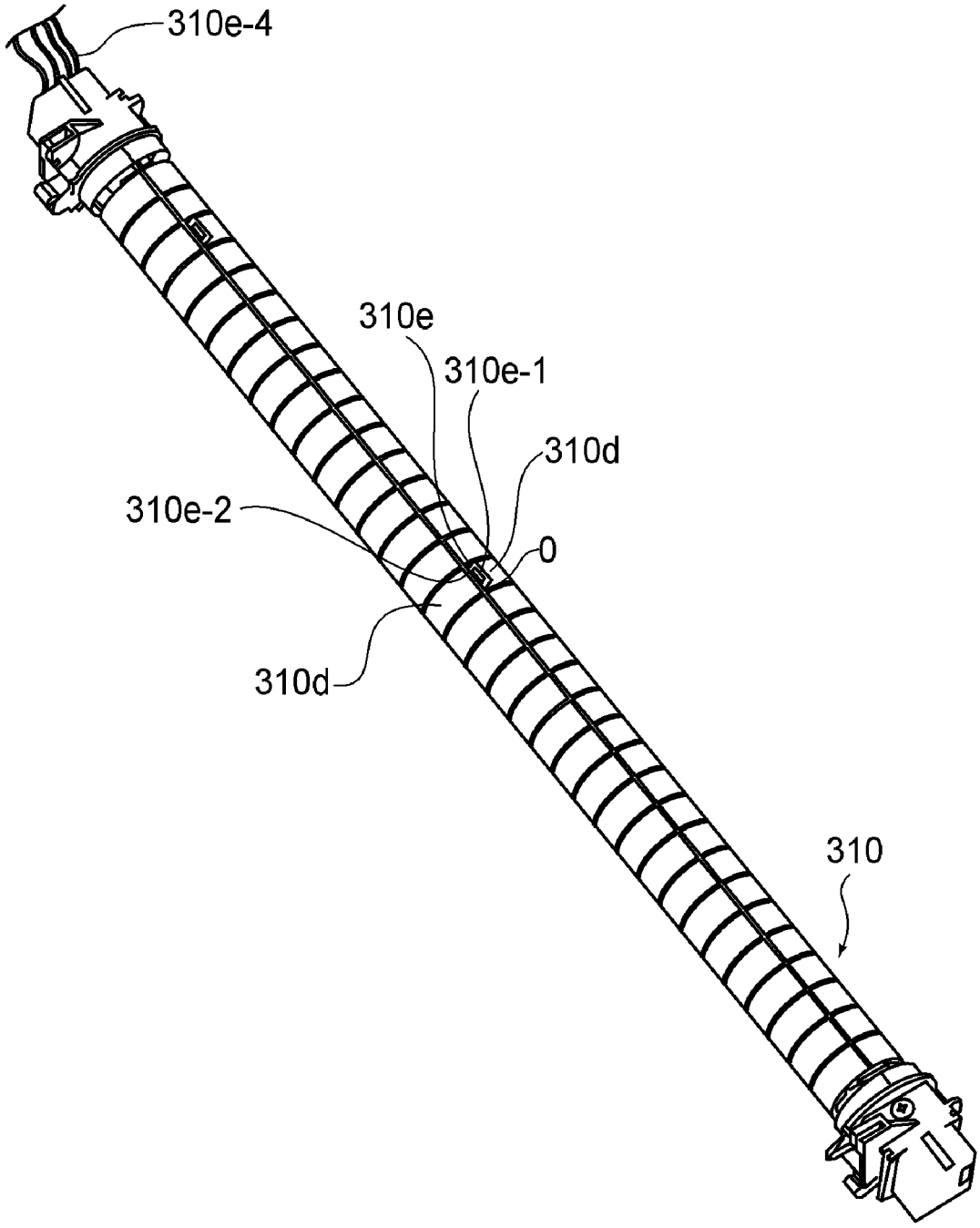
FIG. 14 is a schematic view for illustrating an inner structure of a belt assembly in Embodiment 2.

FIG. 14 is a schematic view for illustrating an inner structure of a belt assembly 310 in this embodiment.

Figure 15:
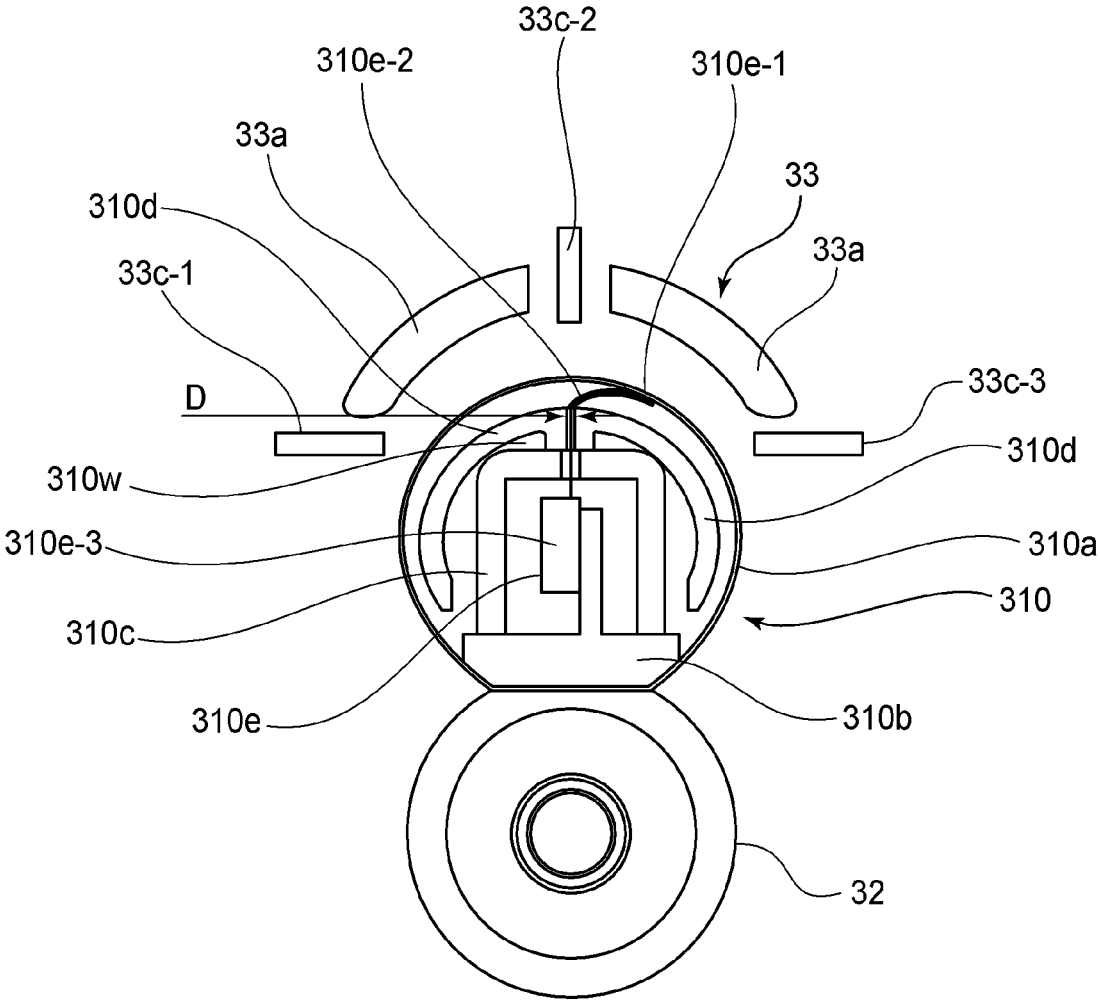
FIG. 15 is an enlarged schematic cross-sectional view of a fixing device (apparatus) in Embodiment 2.

FIG. 15 is an enlarged schematic cross-sectional view of a fixing device in this embodiment. In this embodiment, as the temperature detecting means, a thermistor 310*e* is disposed.

(1) Temperature Detecting Member (Thermistor 310*e*)

Figure 16:
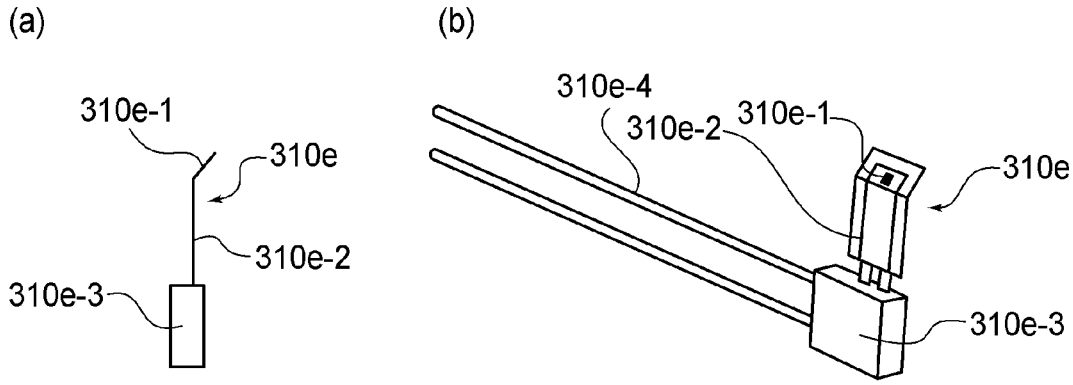
FIGS. 16(*a*) and 16(*b*) are schematic views for illustrating a structure of a thermistor in Embodiment 2.

FIGS. 16(*a*) and 16(*b*) are schematic views for illustrating a structure of the thermistor 310*e* in this embodiment. The thermistor 310*e* is constituted by a temperature detecting portion 310*e*-1, an elastic thin layer portion 310*e*-2, a base portion 310*e*-3, and an electric wire portion 310*e*-4. The temperature detecting portion 310*e*-1 is attached to an end of the elastic thin layer portion 310*e*-2. Then, the temperature detecting portion 310*e*-1 and the elastic thin layer portion 310*e*-2 are electrically connected. Therefore, in this embodiment, the elastic thin layer portion 310*e*-2 and the electric wire portion 310*e*-4 correspond to electric wires. Further, the elastic thin layer portion 310*e*-2 is constituted by a flexible member and the temperature detecting portion as an end portion of the temperature detecting member is caused to press-contact a temperature detecting object to perform temperature detection. Incidentally, the elastic thin layer portion 310*e*-2 and the temperature detecting portion 310*e*-1 are covered with an electrically insulating tape 310*e*-5 as an electrically insulating member. The base portion 310*e*-3 functions as a mounting portion for mounting the thermistor 310*e*. The electric wire portion 310*e*-4 sends electrically detected information obtained from the temperature detecting portion 310*e*-1 to the control portion 100 through the A/D convertor 100*a* similarly as in Embodiment 1.

(2) Image Heating Device and Magnetic Core

The image heating member in this embodiment will be described. The coil unit is the same as that in Embodiment 1. Further, the pressing roller 32 contacts the belt member 31 to form the nip in which the recording material is nip-conveyed similarly as in Embodiment 1. The belt assembly 310 in this embodiment will be described. The belt assembly 310 includes a belt guide member 310*b* which is disposed inside the belt member 31*a* (within the heat generating member) in a semi-arcuate cross-sectional shape and has heat resistivity and rigidity. The belt assembly 310 also includes a metal-made rigid pressing stay 310*c* disposed inside the guide member 310*b* in an inverted U-like cross-sectional shape. The belt assembly 310 further includes a magnetic core (magnetic shield core) 310*d*, as a magnetic shielding member, disposed in an inverted U-like cross-sectional shape so as to cover the outside of the stay 31*c*.

The magnetic core 310*d* is, as shown in FIGS. 14 and 15, divided into two portions in a bilaterally symmetrical manner in the belt assembly 310 with respect to a rotational axis of the image heating member 310*a*. The bilaterally symmetrical magnetic core 310*d*, which is divided into two portions in the bilaterally symmetrical manner in cross-section as shown in FIG. 15, is inversely disposed as shown in FIG. 14, so that the two bilaterally symmetrical portions of the magnetic core 310*d* can be formed of the same material. The magnetic core 310*d* is held by a core holder 310*w*.

(3) Arrangement Relationship

As shown in FIG. 15, the sheet portion 310*e*-2 of the thermistor 310*e* is passed through a lacking portion D ranging from a stay portion to a gap between the divided two portions of the magnetic core 310*d*. In other words, the electric wire (310*e*-2) to be electrically connected to the temperature detecting portion 310*e*-1 passes through the lacking portion D. The base portion 310*e*-3 of the thermistor 310*e* is attached to the guide member 310*b*. The electric wire 310*e*-4 of the thermistor 310*e* is guided inside the stay 310*c* along the guide member 310*b* with respect to a longitudinal direction to be extended to the outside of the belt assembly 310.

Thus, also in this embodiment, it is possible to avoid contact between the electric wire and the image heating member by passing the electric wire through the lacking portion. Incidentally, similarly as in Embodiment 1, the amount of the core in a circumferential area in which the lacking portion D is present is smaller than those at both end portions at which the core is disposed due to the presence of the lacking portion D.

Further, the elastic thin layer portion 310*e*-3(0.3 mm) of the thermistor 310*e* is passed through the gap between the divided portions of the magnetic core 310*d*, i.e., the lacking portion D, so that the lacking portion D can be configured to be smaller than that in the case of passing the electric wire (1.0 mm) through the lacking portion D. Therefore, the belt temperature lowering by the presence of the lacking portion D described in Embodiment 1 is alleviated, so that it is possible to alleviate the degree of loss of induced magnetic field by the lacking portion D, i.e., a degree of power loss.

Further, also in this embodiment, the temperature detecting portion 310*e*-1 is configured to detect the temperature at a position deviated from an opposing position in which the belt member 310*a* opposes the lacking portion D.

Moreover, the above-described loss of the induced magnetic field by the lacking portion D is very small, so that the magnetic core having the same size can be continuously disposed also at a portion where the thermistor 310*e* is not extended in the longitudinal direction as shown in FIG. 14. As a result, all the portions of the magnetic core 310*d* can be formed in the same shape, so that cumbersomeness during device assembly can be eliminated.

In this embodiment, a second thermistor 311*e* as a second temperature detecting member for detecting a temperature at an end portion of the image heating member in the rotational axis direction of the image heating member, as shown in FIG. 14 is disposed. The second thermistor 311*e* is configured similarly as in the first thermistor 310*e* so as to pass the elastic thin layer portion through the lacking portion. The temperature detecting portion of the second thermistor 311*e* detects the temperature at a position avoiding a position in which the belt member 310*a* opposes the lacking portion D.

In the above-described embodiments, the belt member is used as the image heating member but a similar effect can also be obtained by using a thin film member as the image heating member.

As described hereinabove, according to the present invention, it is possible to reduce the degree of contact between the electric wire from the temperature detecting member and the image heating member even when the temperature detecting member is disposed in the area in which the spacing between the temperature detecting member and the magnetic core disposed inside the image heating member is small.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 217840/2008 filed Aug. 27, 2008, which is hereby incorporated by reference.

What is claimed is:

1. An image heating apparatus comprising:

a coil configured to generate magnetic flux;

an endless rotatable heat generating member, having an electroconductive layer which generates heat by the magnetic flux generated by said coil provided outside said endless rotatable heat generating member, and being configured to heat an image on a recording material;

a magnetic member, provided inside said endless rotatable heat generating member, disposed along an area of said endless rotatable heat generating member opposing said coil;

an opening provided through said magnetic member;

a temperature detecting member, provided in an area between said magnetic member and an area of said endless rotatable heat generating member opposing said coil, and configured to detect a temperature of said endless rotatable heat generating member;

an electric wire electrically connected to said temperature detecting member, wherein said electric wire passes through said opening; and an interrupting portion, provided outside said endless rotatable image heating member, configured to interrupt electric power supply to said coil on the basis of an output of said temperature detecting member supplied through said electric wire.

2. An apparatus according to claim 1, further comprising a control portion configured to control electric power supply to said coil depending on the temperature detected by said temperature detecting member, wherein said interrupting portion interrupts the electric power supply to said coil when the detected temperature reaches a preset temperature.

3. An apparatus according to claim 1, wherein said temperature detecting member detects the temperature in an area not including a position of said endless rotatable heat generating member opposing said opening.

4. An apparatus according to claim 1, further comprising a pressing member configured to form a nip in which the recording material is nip-conveyed, a guide portion configured to press said endless rotatable heat generating member against said pressing member and to guide said endless rotatable heat generating member, and a metal stay configured to press said guide portion toward said pressing member, wherein said electric wire is extended to the outside of said endless rotatable heat generating member through a space between said metal stay and said guide portion.

5. An apparatus according to claim 1, further comprising a first magnetic core provided as a part of said magnetic member; and a second magnetic core, provided as a part of said magnetic member, disposed adjacent to said first magnetic core with respect to a rotational direction of said endless rotatable heat generating member, wherein said opening is formed between said first magnetic core and said second magnetic core with respect to the rotational direction.

6. An apparatus according to claim 5, further comprising third magnetic cores provided adjacent to said opening with respect to a longitudinal direction perpendicular to the rotational direction, wherein the length of at least one of said first magnetic core and said second magnetic core with respect to the rotational direction is shorter than those of the third magnetic cores with respect to the rotational direction.

7. An apparatus according to claim 1, wherein said temperature detecting member is disposed so as to oppose an area of said endless rotatable heat generating member where the amount of heat generation by said coil is largest.

8. An image heating apparatus comprising:

a coil configured to generate magnetic flux;

an endless rotatable heat generating member, having an electroconductive layer which generates heat by the magnetic flux generated by said coil provided outside said endless rotatable heat generating member, and configured to heat an image on a recording material;

a magnetic member, provided inside said endless rotatable heat generating member, disposed along an area of said endless rotatable heat generating member opposing said coil;

an opening provided through said magnetic member;

a temperature sensing portion, provided in an area between said magnetic core and an area of said endless rotatable heat generating member opposing said coil, and configured to sense a temperature of said endless rotatable heat generating member;

an electric wire electrically connected to said temperature sensing portion, wherein said electric wire passes through said opening; and a connecting portion, configured to connect to said electric wire, and configured to interrupt electric power supply to said coil when the temperature sensed by said temperature sensing member reaches a predetermined temperature.

9. An apparatus according to claim 8, wherein said temperature sensing portion is provided in an area not including a position of said endless rotatable heat generating member opposing said opening.

10. An apparatus according to claim 8, further comprising a pressing member configured to form a nip in which the recording material is nip-conveyed, a guide portion configured to press said endless rotatable heat generating member against said pressing member and to guide said heat generating member, and a metal stay configured to press said guide portion toward said pressing member, wherein said electric wire is extended to the outside of said endless rotatable heat generating member through a space between said metal stay and said guide portion.

11. An apparatus according to claim 8, further comprising a first magnetic core provided as a part of said magnetic member; and a second magnetic core, provided as a part of said magnetic member, disposed adjacent to said first magnetic core with respect to a rotational direction of said endless rotatable heat generating member, wherein said opening is formed between said first magnetic core and said second magnetic core with respect to the rotational direction.

12. An apparatus according to claim 8, further comprising third magnetic cores provided adjacent to said opening with respect to a longitudinal direction perpendicular to the rotational direction, wherein the length of at least one of said first magnetic core and said second magnetic core with respect to the rotational direction is shorter than those of the third magnetic cores with respect to the rotational direction.

13. An apparatus according to claim 8, wherein said temperature sensing portion is disposed so as to oppose an area of said endless rotatable heat generating member where an amount of heat generation by said coil is largest.

* * * * *